US011369180B1

(12) United States Patent
Khanh

(10) Patent No.: US 11,369,180 B1
(45) Date of Patent: Jun. 28, 2022

(54) MANICURE VENTILATING AND SANITIZING LAMP

(71) Applicant: Tran Thien Khanh, St. Louis, MO (US)

(72) Inventor: Tran Thien Khanh, St. Louis, MO (US)

( * ) Notice: Subject to any disclaimer, the term of this patent is extended or adjusted under 35 U.S.C. 154(b) by 22 days.

(21) Appl. No.: 16/906,226

(22) Filed: Jun. 19, 2020

(51) Int. Cl.

| | |
|---|---|
| ***A45D 29/18*** | (2006.01) |
| ***A45D 29/22*** | (2006.01) |
| ***F26B 9/00*** | (2006.01) |
| ***F26B 3/28*** | (2006.01) |

(52) U.S. Cl.
CPC ..... *A45D 29/18* (2013.01); *A45D 29/22* (2013.01); *F26B 9/003* (2013.01); *A45D 2200/205* (2013.01); *F26B 3/28* (2013.01)

(58) Field of Classification Search
CPC . F26B 9/003; F26B 3/28; A45D 29/18; A45D 29/22; A45D 2200/205
USPC ..... 34/523
See application file for complete search history.

(56) References Cited

U.S. PATENT DOCUMENTS

| | | | | |
|---|---|---|---|---|
| 1,394,667 | A | 10/1921 | Corbin, Jr. | |
| 3,039,678 | A | 6/1962 | Sharpe | |
| 3,667,134 | A * | 6/1972 | Rockson | A61L 2/0047 34/60 |
| 3,860,404 | A | 1/1975 | Jochimski | |
| 4,344,112 | A | 8/1982 | Brown | |
| 4,868,369 | A | 9/1989 | Chen | |
| 4,926,293 | A | 5/1990 | Saba | |
| 5,498,394 | A * | 3/1996 | Matschke | A47K 10/48 250/455.11 |
| 5,546,678 | A * | 8/1996 | Dhaemers | F26B 21/02 34/275 |
| 6,457,254 | B2 * | 10/2002 | Sahm | A45D 4/10 34/96 |
| 6,826,848 | B1 * | 12/2004 | Delaney | A45D 29/00 34/202 |
| 8,597,389 | B2 | 12/2013 | Ton | |
| 8,723,086 | B2 | 5/2014 | McMahan | |
| 8,974,092 | B2 | 3/2015 | Horng et al. | |
| 10,184,489 | B2 | 1/2019 | Avedon | |
| 10,279,063 | B2 * | 5/2019 | Liu | A46B 17/065 |
| 2006/0232984 | A1 | 10/2006 | Schuknecht et al. | |
| 2009/0314308 | A1 * | 12/2009 | Kim | A61L 2/24 134/1 |
| 2012/0020057 | A1 | 1/2012 | Lin | |
| 2014/0231677 | A1 * | 8/2014 | Cheng | A45D 29/00 250/492.1 |

(Continued)

*Primary Examiner* — Stephen M Gravini
(74) *Attorney, Agent, or Firm* — Grace J. Fishel

(57) ABSTRACT

A ventilating and sanitizing lamp for use in a nail salon with a visible light source and a germicidal light source in a hood connected to a elongated hollow member. Heat from the visible light source effects convective air flow from the hood out of the elongated hollow member. An impeller positioned in the elongated hollow member above the visible light source and below the germicidal light source assists the convective air through the elongated hollow member. Air laden with dust and chemicals is pulled into the hood and out of a nail technician's breathing zone together with any bacteria, molds and viruses which are deactivated by the germicidal light source before the air is expelled above the heads of the operator and his or her client.

10 Claims, 6 Drawing Sheets

(56) References Cited

U.S. PATENT DOCUMENTS

| | | | | |
|---|---|---|---|---|
| 2016/0038624 | A1* | 2/2016 | Krosney | A61L 9/20 422/121 |
| 2018/0036553 | A1* | 2/2018 | Shiibashi | A45D 20/12 |
| 2021/0299311 | A1* | 9/2021 | Yu | B08B 7/0057 |

* cited by examiner

MANICURE VENTILATING AND SANITIZING LAMP

BACKGROUND OF THE INVENTION

Field of the Invention

The present invention relates to a ventilating and sanitizing lamp for use in a nail salon at the point a manicure is being given by a nail technician to a client.

Brief Description of the Prior Art

Approximately 400,000 people are employed in nail salons and other services in the United States according to industry estimates (Nails Magazine, 2008-2009). These estimates indicate the workforce is largely female (96%) with the industry employing a large number of minority workers (63%). Nail salon employees are potentially exposed to dozens of chemicals including acrylates, solvents, and biocides as dusts, smells, or vapors and to exposure to infectious pathogens because of the personal service rendered.

Manicures are performed at a workstation—or "nail table" or "manicure table"—with the client's hands resting on the table as the technician works. The manicure table is, therefore, directly below the nail technicians' and client's breathing zone and social distancing is not possible.

Most nails salons are small sized and in tight quarters. They usually have a waiting area for customers in addition to a number of booths and chairs where customers have their nail done. In such a cramped space, the air is exposed to the chemicals that are used at the booths affecting not only the customers there, but also the customers in the waiting area as well. Customers often complain about the unpleasant odor in the waiting area and infectious pathogens from others may also spread into the waiting area.

The chemicals commonly used in nail salons and their common toxic effects include:

1. Acetone (nail polish remover): headache; dizziness; and irritated eyes, skin, and throat.
2. Acetonitrile (fingernail glue remover): irritated nose and throat; breathing problems; nausea; vomiting; weakness; and exhaustion.
3. Butyl acetate (nail polish, nail polish remover): headache and irritated eyes, skin, nose, mouth, and throat.
4. Dibutyl phthalate (DBP), (nail polish): nausea and irritated eyes, skin, nose, mouth, and throat. Long-term exposures to high concentrations may cause other serious effects.
5. Ethyl acetate (nail polish, nail polish remover, fingernail glue): irritated eyes, stomach, skin, nose, mouth, and throat, high levels can cause fainting.
6. Ethyl methacrylate (EMA), (artificial nail liquid): asthma; irritated eyes, skin, nose, and mouth; difficulty concentrating. Exposures while pregnant may affect your child.

7. Formaldehyde (nail polish, nail hardener): difficulty breathing, including coughing, asthma-like attacks, and wheezing; allergic reactions; irritated eyes, skin, and throat. Formaldehyde can cause cancer.
8. Isopropyl acetate (nail polish, nail polish remover): sleepiness, and irritated eyes, nose, and throat.
9. Methacrylic acid (nail primer): skin burns and irritated eyes, skin, nose, mouth, and throat. At higher concentrations, this chemical can cause difficulty breathing.

10. Methyl methacrylate (MMA) (artificial nail products, though banned for use in many states): asthma; irritated eyes, skin, nose, and mouth; difficulty concentrating; loss of smell.
11. Quaternary ammonium compounds (disinfectants): irritated skin and nose and may cause asthma.
12. Toluene (nail polish, fingernail glue): dry or cracked skin; headaches, dizziness, and numbness; irritated eyes, nose, throat, and lungs; damage to liver and kidneys; and ham to unborn children during pregnancy.
13. Toluene, formaldehyde, and dibutyl phthalate are sometimes referred to in the industry as the "toxic trio".

Nail solon employees are especially at risk given their long-term exposure and/or their exposure to high concentrations of the above-mentioned chemicals in the work environment. No doubt customers of nail salons are exposed to toxic chemicals when they get their nails done. This may be particularly hazardous to children and pregnant women both of whom can be seen at nail salons frequently. As to infectious pathogens, even when face masks and face shields are used, both the technician and the client are at risk as are others in the salon.

A nail salon is supposed to be a haven where customers look forward to spending time. It should be a place to relax and unwind, where customers come to look and feel beautiful. The air that they should be fresh and clean but in reality the air they breath in most of nail salons is filled with pollutants and toxic.

BRIEF SUMMARY OF THE INVENTION

In view of the above, it is an object of the present invention to provide an improved ventilating and sanitizing lamp for use in a nail salon that removes harmful chemicals, toxic nail fumes, bad odors from nail products at point of nail services and destroys infectious pathogens.

An embodiment of the manicure ventilating and sanitizing lamp includes a housing having a hood forming an inlet to which is flowably attached a elongated hollow member forming an outlet. To provide effective convective air flow through the elongated hollow member from a visible light source at least partially in the hood, the elongated hollow member has a diameter equal to or less than ½ an overall diameter of the hood and a height equal to or more than twice a an overall height of the hood. These proportions in addition to providing convective air flow provide an aesthetically pleasing appearance which is important in a salon environment. An impeller is located in the elongated hollow member above the visible light source and below a germicidal light source. Air laden with nail filings and chemicals is drawn from an operator's breathing zone and infectious pathogens deactivated by the germicidal light before being expelled above the heads of the operator and his or her client.

In another embodiment of the lamp the visible light source comprises one or more LEDs and the germicidal light source comprises one or more UVC LEDs or mercury vapor lamps. In some embodiments the elongated hollow member has a reflective lining for intensifying the UV radiation from the germicidal light source.

In some applications the mercury vapor lamps are arranged longitudinally in the elongated hollow member and in other applications the UVC LEDs are arranged on a perforated LED substrate arranged transverse the elongated hollow member.

In another aspect the manicure sanitizing lamp is mounted on a support arm including a upper lamp pivot attached to the housing, an elbow and a lower lamp pivot. The support arm may be supported by a weight base or be attached to a manicuring table.

In some embodiments, the base may include compartments for nail files, drill bits and the like and at least one USB port. In other embodiments when the support arm is attached to a manicuring table, the table may include a grill in the top surface connected to a vacuum system for reducing or eliminating the flow of nail filings into the lamp. In other cases, a carbon filter may be provided in elongated hollow member to collect dust and nail filings.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
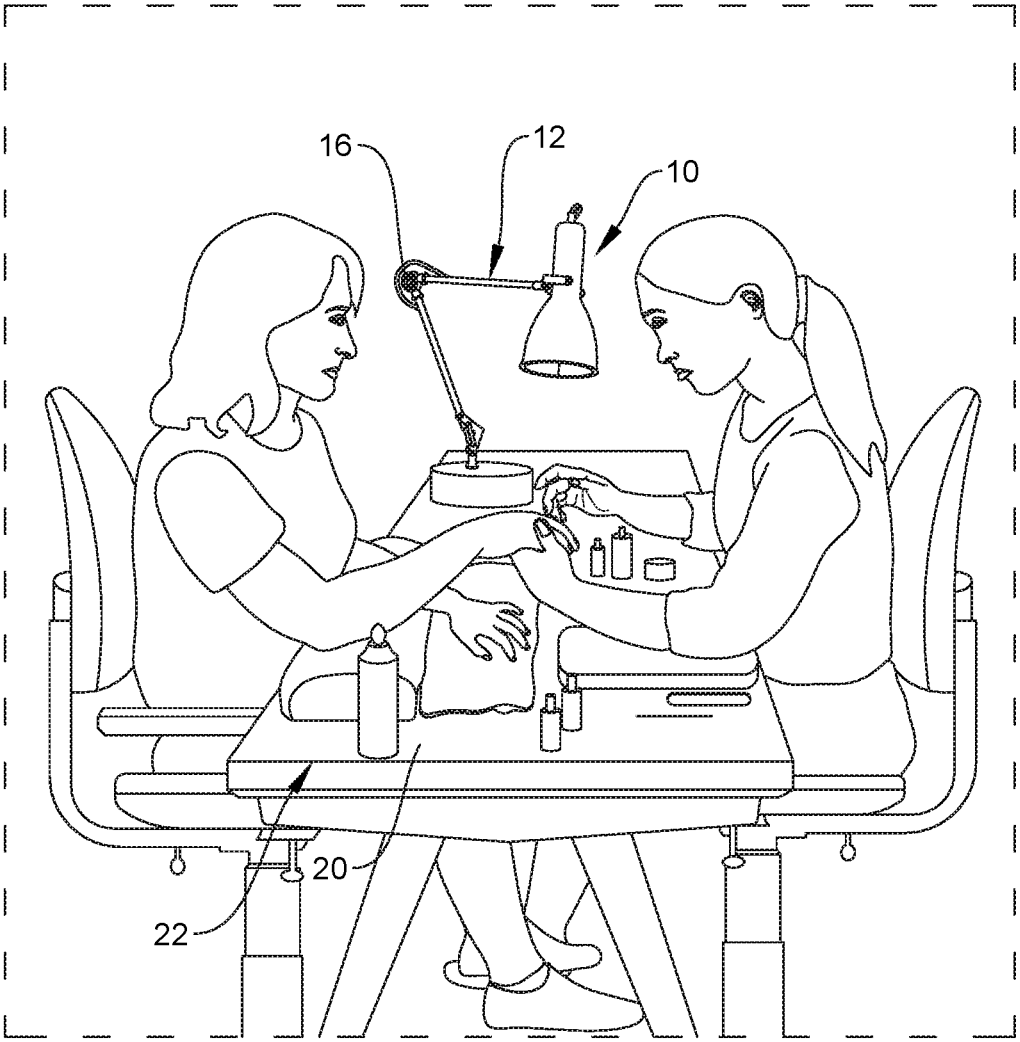
FIG. 1 is a perspective view of a manicurist performing a manicure for a client with a manicure table outfitted with a manicure ventilating and sanitizing lamp in accordance with the present invention.
Figure 2:
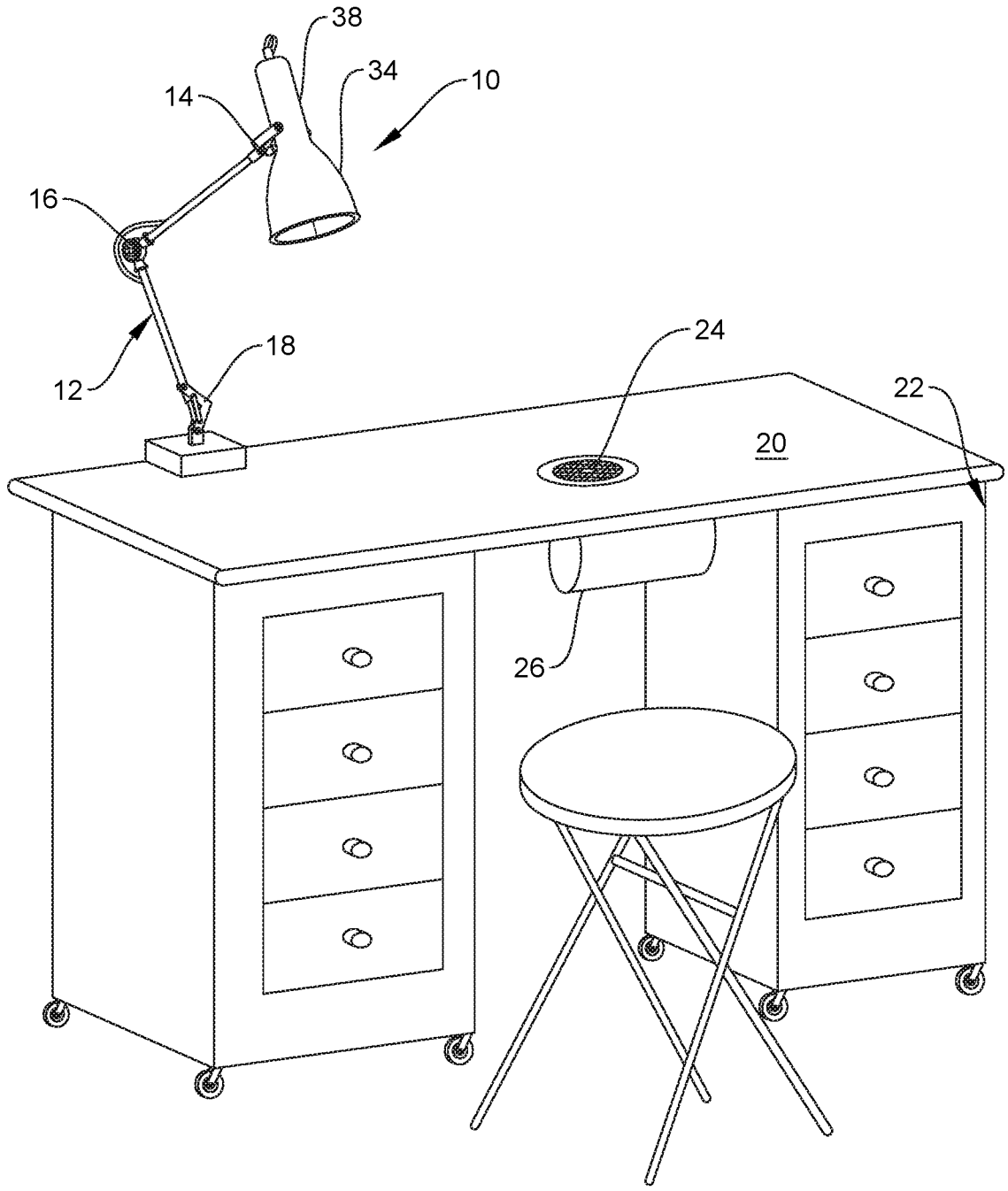
FIG. 2 is a perspective view of a manicure table outfitted with a manicure ventilating and sanitizing lamp in accordance with the present invention.
Figure 3:
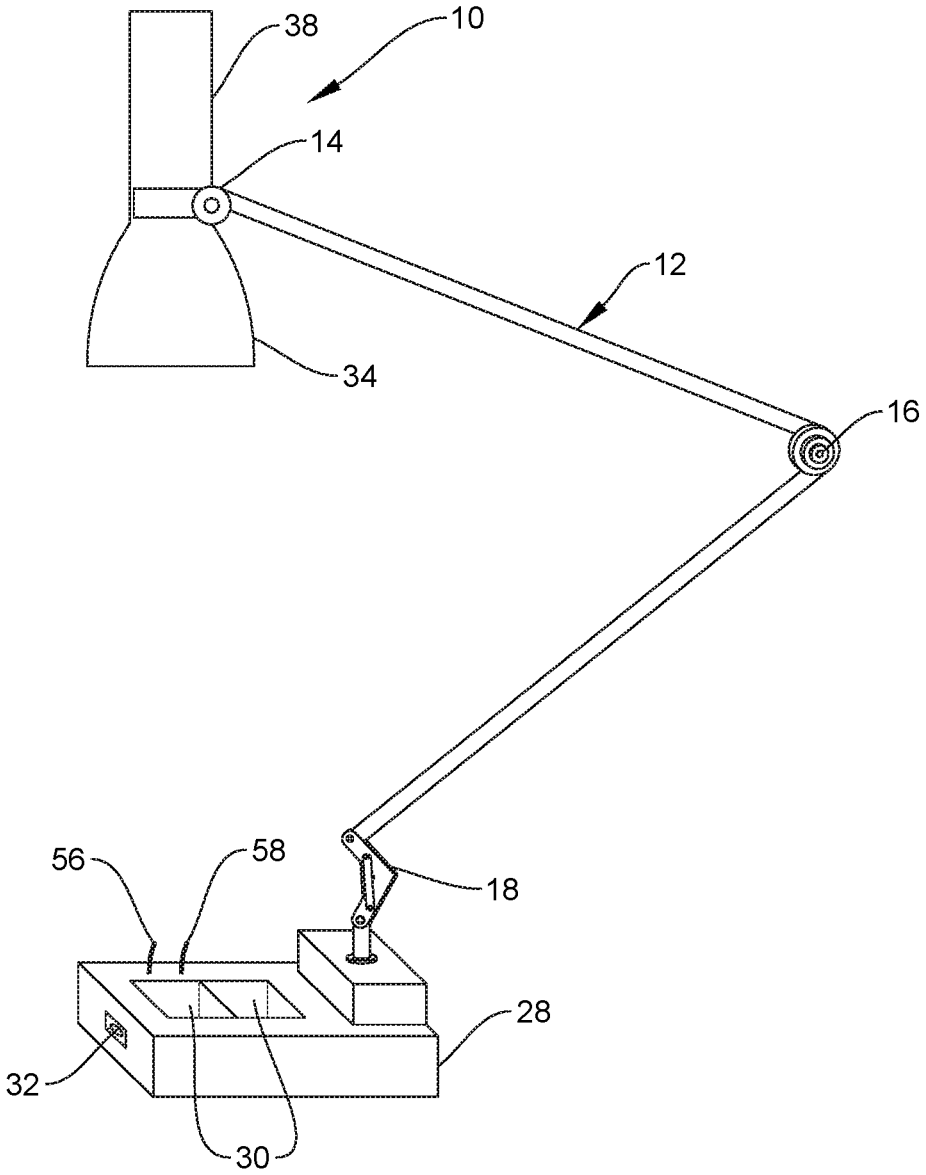
FIG. 3 is a perspective view of a manicure ventilating and sanitizing lamp mounted on a weighted base.

Referring to the drawings more particularly by reference character, reference numeral 10 refers to a manicure ventilating and sanitizing lamp in accordance with the present invention. As shown in FIGS. 1-3, lamp 10 is mounted on a support arm 12 including an upper lamp pivot 14, an elbow 16 and a lower lamp pivot 18. The pivots may be hinge or ball joint that allows a user to adjust the angle of the lamp (upper lamp pivot 14), allows for variable adjustment of the lamp from a support surface 20 (elbow 16) and allows the user to adjust the angle of support arm with respect to support surface 20 (lower lamp pivot 18). A seen in FIGS. 1-2, support surface 20 comprises the table top of a manicurist's table 22 to which support arm 12 may be attached. In some embodiments table top 20 may include a grill 24 connected to a vacuum system 26 for reducing or eliminating the flow of nail filings into lamp 10 as more particularly described below. In other embodiments, a portable electric nail dust collector may be used. Turning to FIG. 3, support surface 20 is integrated into a weighted base 28 which may be sat upon a manicurist's table 22. In the form illustrated, base 28 includes at least two compartments 30 for nail files and nail drill bits. Base also may include at least one USB port 32.

Figure 4:
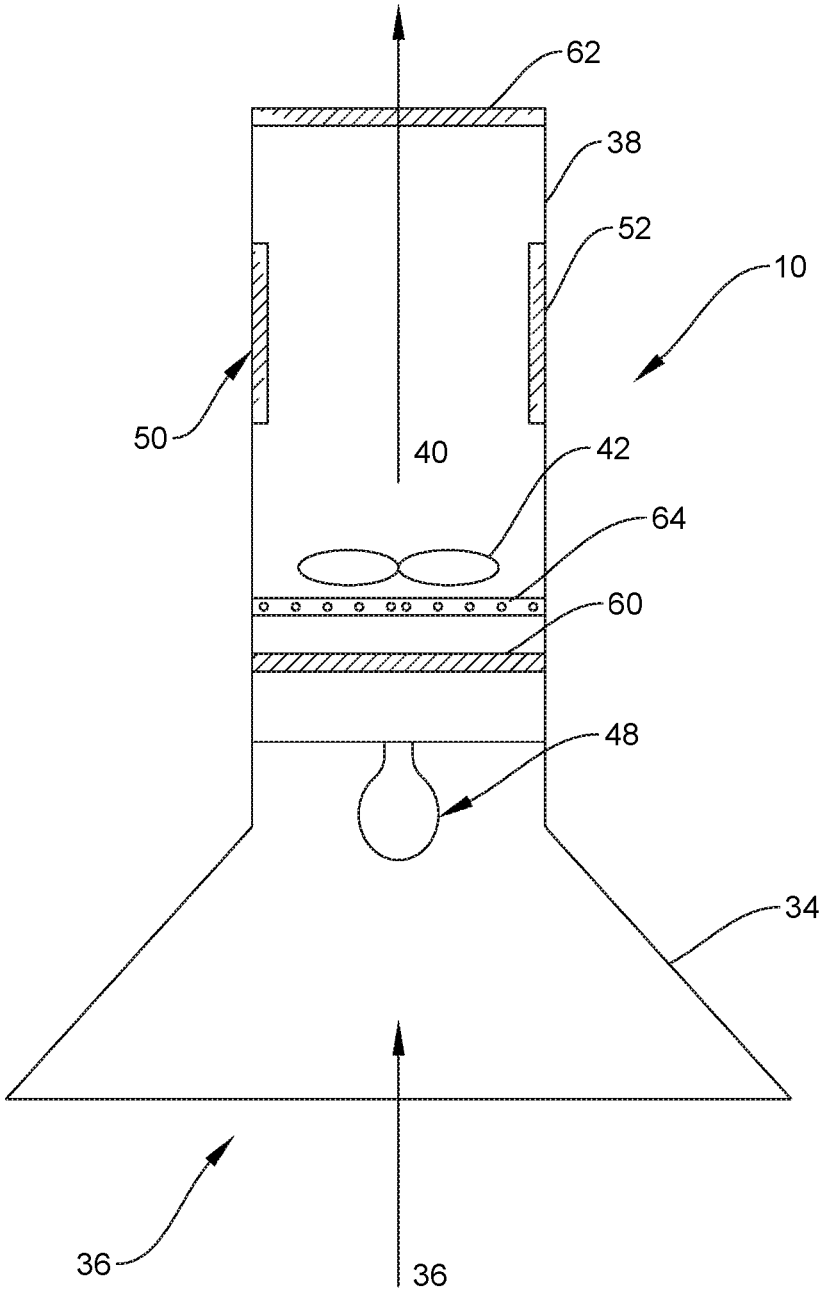
FIG. 4 is a representational line sketch, in sectional view, showing a manicure ventilating and sanitizing lamp.
Figure 5:
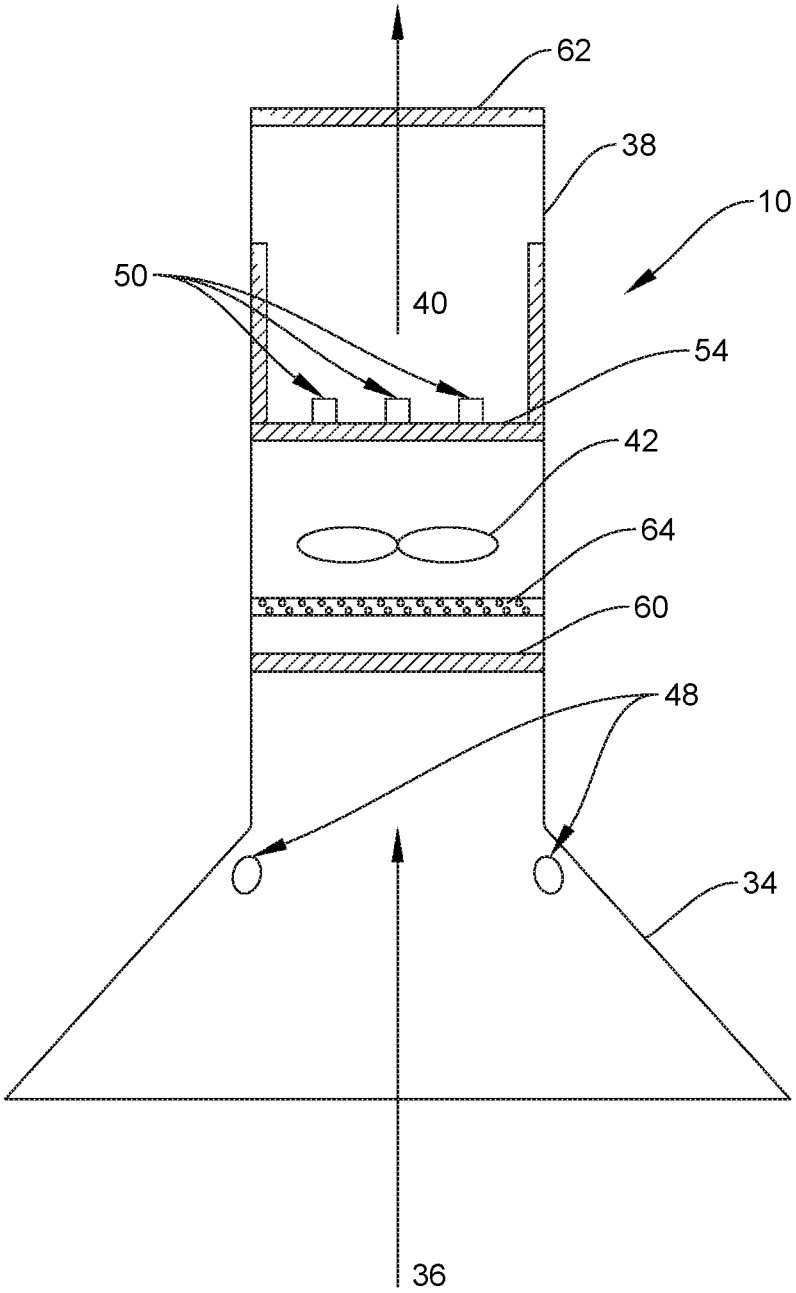
FIG. 5 is a representational line sketch, in sectional view, showing another manicure ventilating and sanitizing lamp.

As shown in FIGS. 4 and 5, manicure ventilating and sanitizing lamp 10 includes a housing with a hood 34 which may be conical or have a square, oval or other cross-section in shape and forms an inlet 36 to housing to which is attached a elongated hollow member 38 which may be cylindrical or have a square, oval or other cross-section and forms an outlet 40. Elongated hollow member 38 has a diameter equal to or less than ½ an overall diameter of hood 34 and a height equal to or more than twice an overall height of hood 34. These dimensions appear critical to providing an effective draft sufficient to establish a convective air flow through housing between inlet 36 and outlet 40 although some deviations may be permissible.

Figure 6:
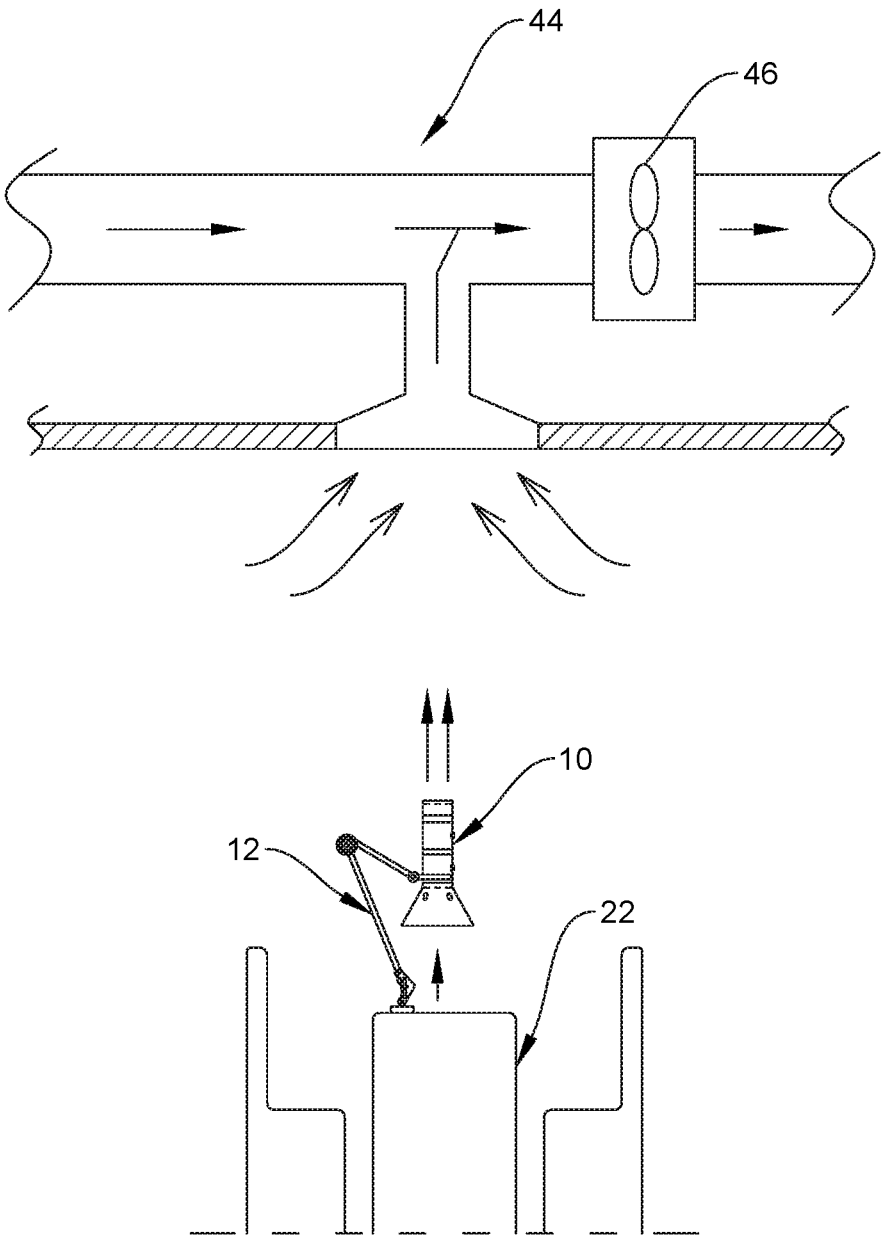
FIG. 6 is representational line sketch showing a manicurist's work station outfitted with a manicure ventilating and sanitizing lamp that pulls air out of the nail technician's and client's breathing zone and ducts it upwards into the salon's ventilation system.

An impeller 42 is located in elongated hollow member 38 and is configured to move air through the housing from inlet 36 to outlet 40 as an assist to the convective air flow. Impeller 42 is a centrifugal fan and is attached to a drive shaft of a motor which drives the fan. As shown in FIG. 6, outlet 40 of manicure ventilating and sanitizing lamp 10 is positioned above the head of the manicurist and his or her client where air passing through the housing is dissipated in the room or pulled into and exhausted through a shop ventilation system 44 with a fan 46.

A visible light source 48 is positioned at least partially in hood 34 upstream of impeller 42. Visible light source 48 may be an ordinary incandescent light bulb, a halogen bulb or a compact fluorescent bulb but is preferably one or more LEDs. As shown in FIG. 4, visible light source 48 may be centrally located in hood 34 or as shown in FIG. 5 be mounted about the upper peripheral edge of hood 34.

A germicidal light source 50 is positioned in elongated hollow member 38 downstream of impeller 42. Germicidal light source 50 is preferably a UVC light. As is known, a wavelength of about 254 nm is most destructive of organisms such as bacteria, mold and viruses but other longer or shorter wavelengths may be used with appropriate adjustments in residence time. In the case of a mercury vapor lamp as shown in FIG. 4, the UV light is directed in a generally inward direction as shown and in the case of UVC LEDs in a generally upward direction as shown in FIG. 5. A reflective lining 52 in elongated hollow member 38 intensifies the UV radiation coming from germicidal light source 50. Referring back to FIG. 4, mercury vapor lamps 50 are arranged longitudinally in elongated hollow member 38 and in FIG. 5 the UVC LEDs are mounted on a perforated LED substrate 54 positioned transverse elongated hollow member 38. Air flow is along the length of mercury vapor lamps 50 or through perforated LED substrate 54 and over the UV LEDs.

Impeller 42 may be powered from the same source of power used to energize visible light 48 and germicidal light source 50. As shown in FIG. 3, a switch 56 turns on visible light source 48 which may be used independently. A second switch 58 energizes impeller 42 and germicidal light 50 which should not be operated without air being actively pulled through the housing as convective air flow may provide insufficient cooling of germicidal light source 50.

A first grill 60 is provided in elongated hollow member 38 below impeller 42 and a second grill 62 is provide in outlet 40. First and second grills 60, 62 may inhibit or prevent unwanted debris from entering the interior space of the housing or personal injury from impeller 42 or germicidal light source 50. A carbon filter 64 may be provided downstream of impeller 42 to trap dust and nail filings.

In use, with visible light source 48, germicidal light source 50 and impeller 42 activated, vapors and dusts normally generated as a manicurists performs a manicure are drawn up and away from the operator and his or her client.

Nail files and bits may be in easy reach in 28 and nail filings may be removed with vacuum system 26 or caught in carbon filter 64. More importantly, air borne bacteria, molds and viruses are drawn into manicure ventilating and sanitizing lamp 10 and are deactivated before being harmlessly expelled above the heads of the operator and his or her client where they may be advantageously further dissipated by the salon's ventilation system 44.

In view of the above, it will be seen that the object of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A manicure ventilating and sanitizing lamp comprising a housing having a hood with a hood outside inlet to which is flowably attached an elongated hollow member having an elongated hollow member outside outlet; said elongated hollow member having a diameter equal to or less than ½ an overall diameter of the hood and a height equal to or more than twice an overall height of the hood for convective air flow through the housing from the hood outside inlet which is exhausted from the housing through the elongated hollow member outside outlet;

an impeller located in the elongated hollow member configured to move air through the housing from the hood outside inlet to the elongated hollow member outside outlet as an assist to the convective air flow;

a visible light source positioned at least partially in the hood upstream of the impeller; and a germicidal light source positioned in the elongated hollow member downstream of the impeller wherein the impeller and the convective air flow circulates air through the lamp and the germicidal light source in the lamp deactivates air borne bacteria, molds and virus as the air passes through the lamp.

2. The lamp of claim 1 wherein the visible light source comprises one or more LEDs and wherein the germicidal light source comprises one or more UVC LEDs or mercury vapor lamps emitting UV radiation.

3. The lamp of claim 2 wherein the elongated hollow member includes a reflective lining for intensifying the UV radiation from the germicidal light source.

4. The lamp of claim 2 wherein the mercury vapor lamps are arranged longitudinally in the elongated hollow member.

5. The lamp of claim 2 wherein the UVC LEDs are arranged on a perforated LED substrate arranged transverse the elongated hollow member.

6. A manicure ventilating and sanitizing lamp mounted on a support arm, said lamp comprising a housing having a hood as with a hood outside inlet to which is flowably attached an elongated hollow member having an elongated hollow member outside outlet; for convective air flow through the housing said elongated hollow member having a diameter equal to or less than ½ an overall diameter of the hood and a height equal to or more than twice an overall height of the hood for convective air flow through the housing from the hood outside inlet and exhausted from the housing through the elongated hollow member outside outlet;

an impeller located in the elongated hollow member configured to move air through the housing from the hood outside inlet to the elongated hollow member outside outlet as an assist to the convective air flow;

a visible light source positioned at least partially in the hood upstream of the impeller; and a UVC light source positioned in the elongated hollow member downstream of the impeller said support arm including a upper lamp pivot attached to the housing, an elbow and a lower lamp pivot wherein the impeller and the convective air flow circulates air through the lamp and a germicidal light source in the lamp deactivates air borne bacteria, molds and virus as the air passes through the lamp.

7. The lamp of claim 6 wherein the visible light source comprises one or more LEDs and wherein the UVC light source comprises one or more UVC LEDs or mercury vapor lamps.

8. The lamp of claim 7 wherein the lower lamp pivot is attached to a manicuring table.

9. The lamp of claim 8 wherein the manicuring table has a grill in the top surface connected to a vacuum system for reducing or eliminating the flow of nail filings into the lamp.

10. The lamp of claim 7 connected to a weighted base, said base including at least two compartments for nail files and nail drill bits and at least one USB port.

* * * * *